US007920138B2

(12) United States Patent
Kim

(10) Patent No.: US 7,920,138 B2
(45) Date of Patent: Apr. 5, 2011

(54) LIQUID CRYSTAL PANEL, LIQUID CRYSTAL DISPLAY DEVICE HAVING THE SAME AND METHOD FOR DRIVING THE SAME

(75) Inventor: Eui Tae Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 813 days.

(21) Appl. No.: 11/640,904

(22) Filed: Dec. 19, 2006

(65) Prior Publication Data

US 2007/0296658 A1 Dec. 27, 2007

(30) Foreign Application Priority Data

Jun. 21, 2006 (KR) ..... 10-2006-0055667

(51) Int. Cl.
*G09G 3/36* (2006.01)
*G09G 5/00* (2006.01)

(52) U.S. Cl. ..... 345/209; 345/87

(58) Field of Classification Search ..... 345/87, 345/209

See application file for complete search history.

(56) References Cited

U.S. PATENT DOCUMENTS

2004/0233182 A1* 11/2004 Chuang et al. ..... 345/204
2006/0284811 A1* 12/2006 Huang ..... 345/92

FOREIGN PATENT DOCUMENTS

JP 2-242228 A 9/1990
JP 04-371996 12/1992
JP 11-271788 A 10/1999
JP 2001-133808 A 5/2001

OTHER PUBLICATIONS

Office Action issued Mar. 16, 2010 in corresponding Japanese Application No. 2006-324185.

* cited by examiner

*Primary Examiner* — Amr Awad
*Assistant Examiner* — Randal Willis
(74) *Attorney, Agent, or Firm* — Morgan, Lewis & Bockius LLP

(57) ABSTRACT

A liquid crystal panel includes a gate line; a data line crossing the gate line to define a pixel region; a common line parallel to the gate line; a first switching part in the pixel region for applying a first voltage from the data line to the pixel region; and a second switching part in the pixel region for applying a second voltage from the common line to the pixel region, wherein the first and second switching parts are simultaneously switched on through the gate line.

11 Claims, 5 Drawing Sheets

LIQUID CRYSTAL PANEL, LIQUID CRYSTAL DISPLAY DEVICE HAVING THE SAME AND METHOD FOR DRIVING THE SAME

This application claims the benefit of Korean Patent Application No. 10-2006-0055667, filed on Jun. 21, 2006, which is hereby incorporated by reference in its entirety.

BACKGROUND OF THE INVENTION

1. Field of the Invention

Embodiments of the present invention relates to a liquid crystal display panel, and more particularly to a liquid crystal display panel for a liquid crystal display device. Embodiments of the invention are suitable for a wide scope of applications. In particular, embodiments of the invention are suitable for driving a liquid crystal panel to improve an image quality of a liquid crystal display device having the same.

2. Description of the Related Art

The development of information-driven society leads to a high demand for various forms of display devices. Examples of these display devices include a liquid crystal display (LCD) device, a plasma display panel (PDP) device, and electro luminescence (EL) display device. In particular, the LCD device, which provides excellent image quality, is light, compact, consumes low power, and can display full color images. Accordingly, the LCD device is widely displacing the cathode ray tube (CRT) as a display of choice. For example, LCD devices are as monitors for car navigation, portable devices, and television.

FIG. 1 shows a circuit diagram of a liquid crystal panel according to the related art. Referring to FIG. 1, a liquid crystal panel 2 includes a plurality of gate lines GL1 to GL3 in a first direction, and a plurality of data lines DL1 to DL3 in a second direction on a first substrate (not shown). The gate lines GL1 to GL3 cross the data lines DL1 to DL3. Pixel regions P are defined by crossings of the gate lines GL1 to GL3 and the data lines DL1 to DL3. The pixel regions P form a matrix on the first substrate of the liquid crystal panel. Thin film transistors (TFTs) and pixel electrodes are formed in each pixel region P of the first substrate. A plurality of common lines VL1 to VL3 are provided in parallel with the gate lines GL1 to GL3, respectively on the first substrate.

Various color filters are disposed in a second substrate (not shown) facing the first substrate to correspond to the pixel regions P. A liquid crystal material (not shown) is interposed between the first substrate and the second substrate.

A plurality of common electrodes are formed in each of the pixel region P diverging from the common line VL1 to VL3. The common electrodes are formed in the pixel regions P in parallel with the pixel electrodes. The common electrodes are electrically connected to the common lines VL1 to VL3.

Each of the pixel electrodes and the common lines overlaps to form a storage capacitance $C_{st}$. The storage capacitance $C_{st}$ maintains a data voltage supplied to the pixel electrode during one frame period. Additionally, a liquid crystal capacitance $C_{lc}$ is formed by the liquid crystal material between the pixel electrode and the common electrode. The liquid crystal capacitance $C_{lc}$ maintains an electric potential difference between the data voltage supplied to the liquid crystal and a common voltage of the common electrode.

The TFT is turned on by a scan signal supplied to the gate lines GL1 to GL3 of the liquid crystal. A data voltage supplied to the data lines DL1 to DL3 is applied to the pixel electrode through the TFT. A common voltage supplied to the common lines VL1 to VL3 is applied to the common electrode. An electric field is generated by an electric potential difference between the data voltage and the common voltage. A desired image is displayed by changing an optical characteristics of the liquid crystal material in accordance with the generated electric field.

The data voltage supplied to the liquid crystal panel 2 can be periodically inverted to prevent afterimages and flickers. The inverted data voltage is supplied between dots, lines, or frames. For example, a positive polarity data voltage having a higher level than the common voltage is supplied during a first time period. Then, the data voltage is inverted during a second time period by supplying a negative polarity data voltage having a lower level than the common voltage. The positive polarity data voltage and the negative polarity data voltage are alternately supplied.

FIG. 2 is a voltage waveform applied to the liquid crystal panel of FIG. 1. Referring to FIG. 2, the scan signal applied to the gate line supplies a gate high voltage $V_{GH}$ having a higher level during one horizontal period H in one frame period, and a gate low voltage $V_{GL}$ having a low level during the remaining part of the frame period. Accordingly, the TFT is turned on by the gate high voltage $V_{GH}$ and is turned off by the gate low voltage $V_{GL}$.

When the gate high voltage $V_{GH}$ is inverted into the gate low voltage $V_{GL}$, the TFT is turned off, and a data voltage $V_d$ charged in the pixel electrode causes a voltage drop, such as a kick-back voltage $\Delta V_p$. Accordingly, the data voltage $V_d$, which drops by an amount corresponding to the kick-back voltage $\Delta V_p$, is charged in the pixel electrode.

The kick-back voltage $\Delta V_p$ is expressed as Equation (1):

$$\Delta V_p = \frac{C_{gs}}{C_{gs} + C_{st} + C_{lc}}(V_{GH} - V_{GL}) \tag{1}$$

where $\Delta V_p$ represents a kick-back voltage. $C_{gs}$ denotes a capacitor between a gate electrode and a source electrode in TFT, $C_{st}$ denotes a storage capacitor, $C_{lc}$ denotes a liquid crystal capacitor. $V_{GH}$ and $V_{GL}$ represent a gate high voltage and a gate low voltage, respectively.

In the related art LCD device, the kick-back voltage $\Delta V_p$ occurs in a positive polarity data voltage and a negative polarity data voltage. In this case, although the positive polarity data voltage and the negative polarity data voltage have an identical grayscale, the common voltage does not have an intermediate value. Thus, flickers occur because an identical grayscale can not produced. The common voltage needs to be tuned to prevent these flickers.

Additionally, since a gamma voltage value needs to be tuned to prevent the flickers, an additional unit, such as a tuner, is required to tune the gamma voltage value. Therefore, the gamma voltage generator becomes complicated, and increases in size.

Moreover, the related art gamma voltage generator includes a positive polarity gamma voltage generator generating a gamma voltage corresponding to white, and a negative polarity gamma voltage generator for generating a gamma voltage corresponding to black. Thus, the related art LCD device requires two different gamma voltage generators white and black, a circuit of a gamma voltage generator becomes more complicated, and its size increases more.

SUMMARY OF THE INVENTION

Accordingly, embodiments of the present invention are directed to a liquid crystal pane, a liquid crystal display device having the same, and a method for driving the same that substantially obviate one or more problems due to limitations and disadvantages of the related art.

An object of the present invention is to provide a liquid crystal panel capable of preventing flicker.

Another object of the present invention is to prevent flicker in a liquid crystal display device.

Another object of the present invention is to provide a method for driving a liquid crystal panel to prevent flicker.

Another object of the present invention is to provide a method for driving a liquid crystal panel to prevent flicker using a simplified circuit.

Another object of the present invention is to provide a device having a reduced complexity for driving a liquid crystal panel to prevent flicker using a reduced.

Additional features and advantages of the invention will be set forth in the description of exemplary embodiments which follows, and in part will be apparent from the description of the exemplary embodiments, or may be learned by practice of the exemplary embodiments of the invention. These and other advantages of the invention will be realized and attained by the structure particularly pointed out in the written description of the exemplary embodiments and claims hereof as well as the appended drawings.

To achieve these and other advantages and in accordance with the purpose of the present invention, as embodied and broadly described, a liquid crystal panel includes a gate line; a data line crossing the gate line to define a pixel region; a common line parallel to the gate line; a first switching part in the pixel region for applying a first voltage from the data line to the pixel region; and a second switching part in the pixel region for applying a second voltage from the common line to the pixel region, wherein the first and second switching parts are simultaneously switched on through the gate line.

In another aspect, an LCD device includes a liquid crystal panel including a plurality of pixel regions; a gate driver supplying scan signals to activate the pixel regions; a gamma voltage generator, including a buffer for buffering at least a first gamma voltage and an inverter for inverting the at least first gamma voltage to generate at least a second gamma voltage symmetrical to the at least first gamma voltage with respect to a common voltage; and a data driver supplying data voltages to the activated pixel regions in accordance with the at least first and the at least second gamma voltages from the gamma voltage generators.

In another aspect, a method is presented for driving a liquid crystal display device including a liquid crystal panel with a plurality of pixel regions; the method includes activating the pixel regions by supplying scan signals thereto; buffering at least a first gamma voltage; generating at least a second gamma voltage symmetrical to the at least first gamma voltage with respect to a common voltage; and supplying data voltages to the activated pixel regions in accordance with the at least first and the at least second gamma voltages.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF EXEMPLARY EMBODIMENTS

Reference will now be made in detail to exemplary embodiments of the present invention, examples of which are illustrated in the accompanying drawings. Wherever possible, the same reference numbers will be used throughout the drawings to refer to the same or like parts.

Figure 1:
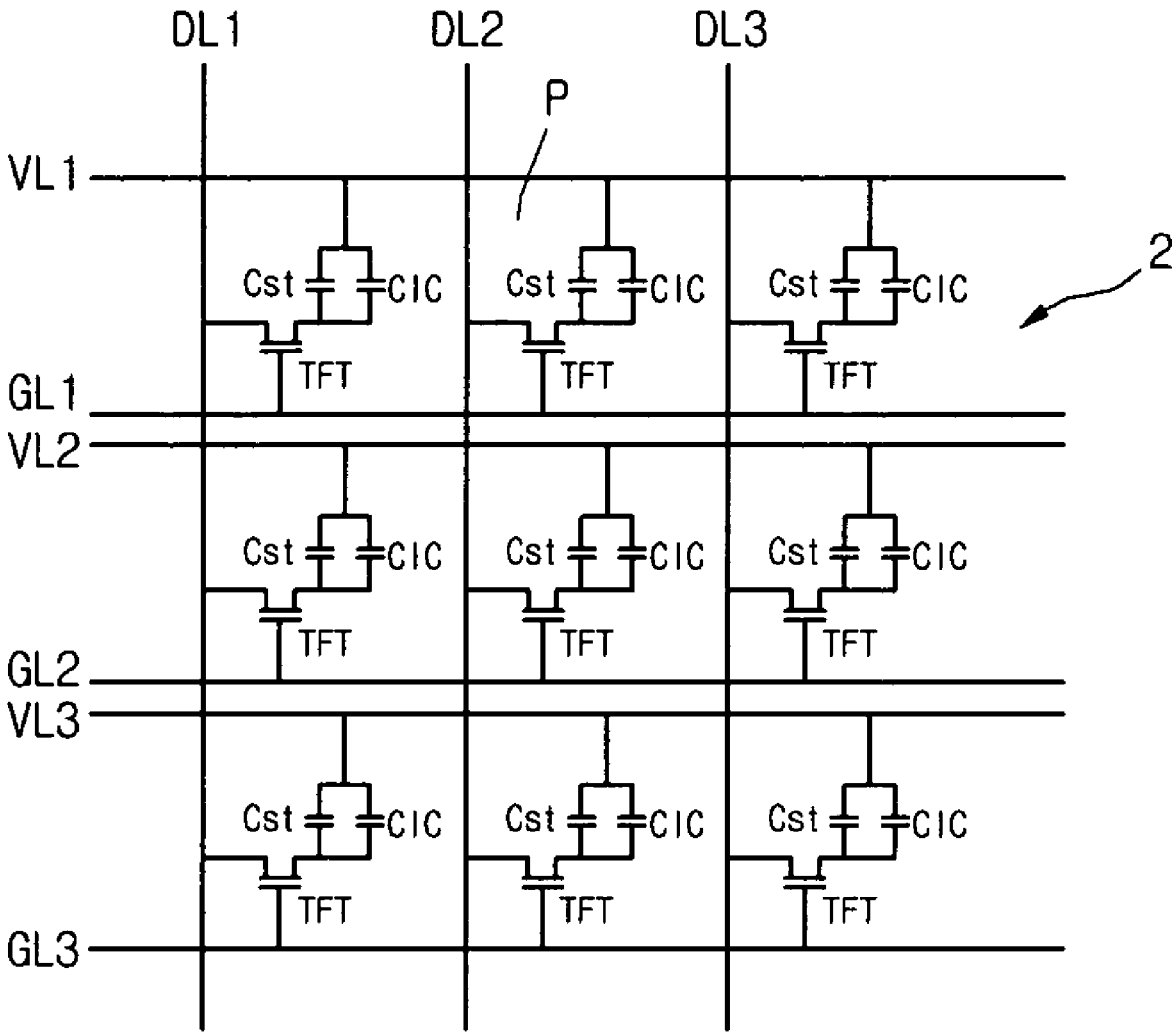
FIG. 1 shows a circuit diagram of a liquid crystal panel according to the related art.
Figure 2:
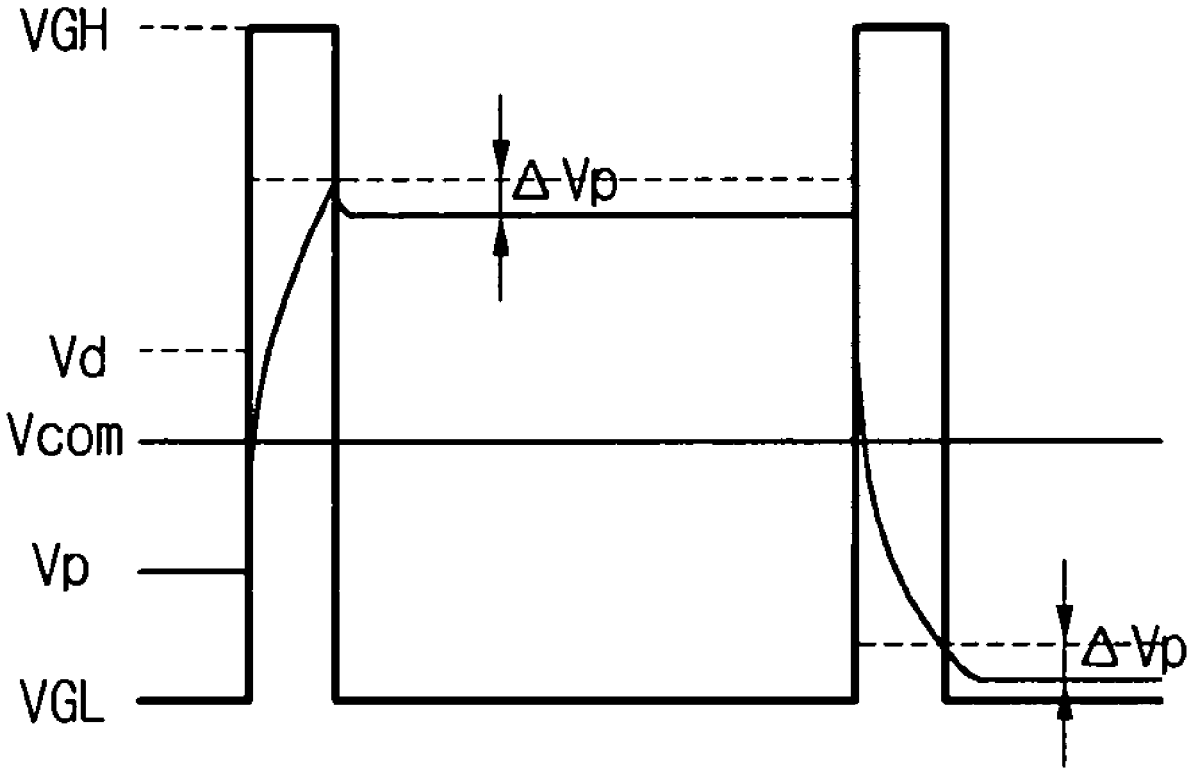
FIG. 2 shows a voltage waveform applied to the liquid crystal panel of FIG. 1.
Figure 3:
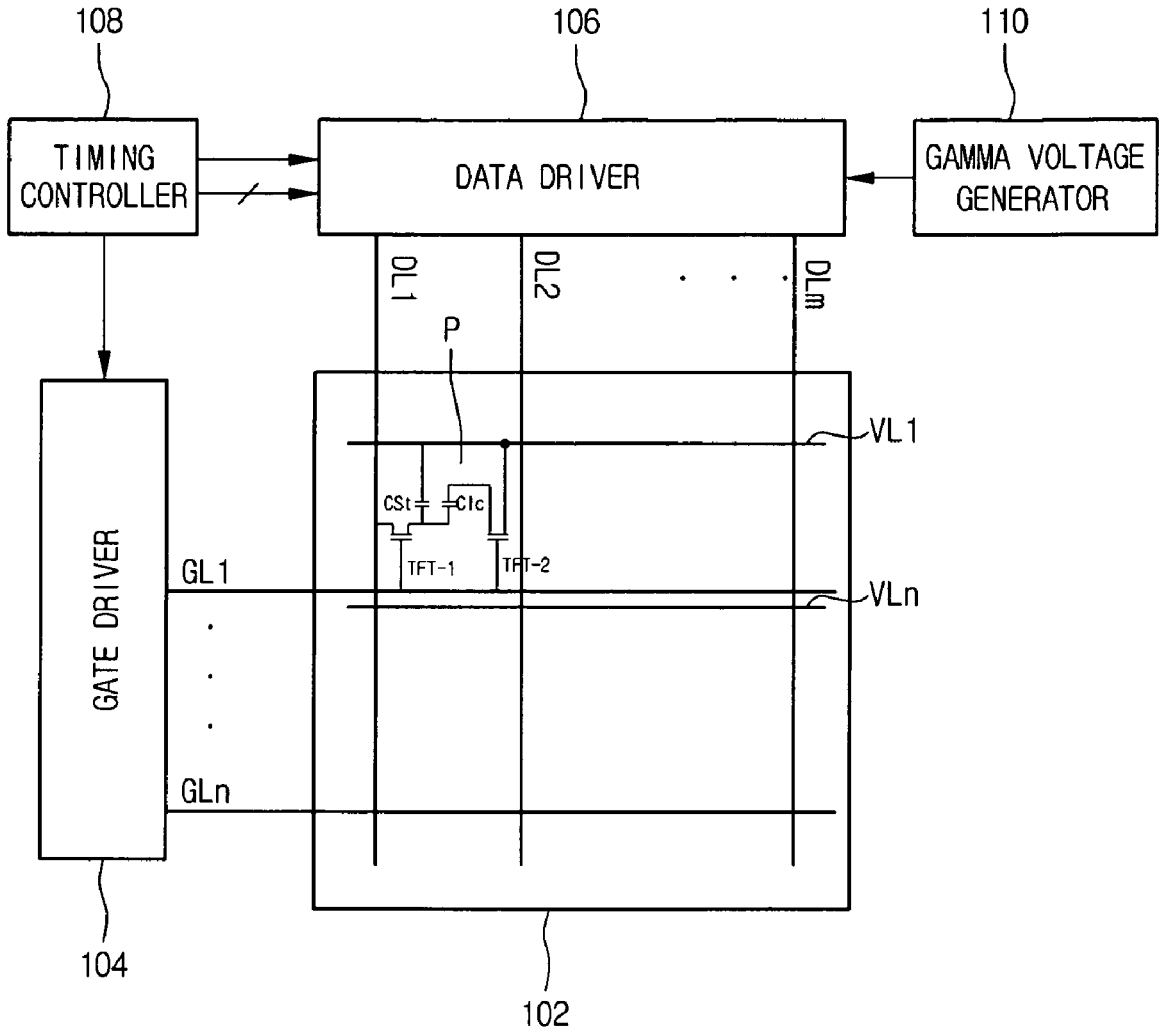
FIG. 3 shows a schematic diagram of an LCD device according to an embodiment of the present invention.

FIG. 3 shows a schematic diagram of an LCD device according to an embodiment of the present invention. Referring to FIG. 3, the LCD device includes a liquid crystal panel 102, a gate driver 104, a gamma voltage generator 110, a data driver 106, and a timing controller 108. The liquid crystal panel 102 includes pixel regions P defined by a plurality of gate lines GL1 to GLn and a plurality of data lines DL1 to DLm crossing each other. The pixel regions P are arranged in a matrix. The gate driver 104 activates the gate lines GL1 to GLn of the liquid crystal panel 102. The gamma voltage generator 110 generates a gamma voltage that is converted to a data voltage corresponding to an input data signal. The data driver 106 supplies the data voltage to the data lines DL1 to DLm of the liquid crystal panel 102. The timing controller 108 controls the gate driver 104 and the data driver 106.

Figure 4:
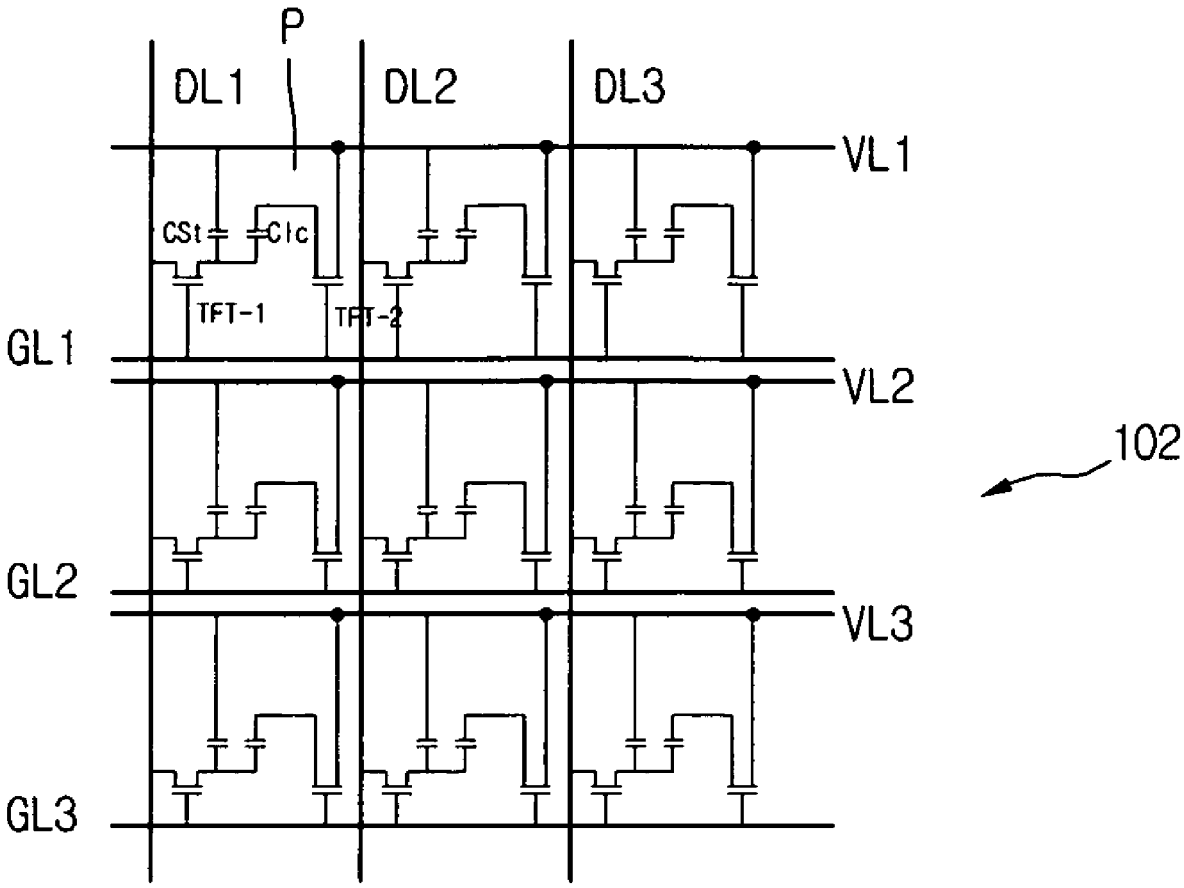
FIG. 4 shows a circuit diagram of a liquid crystal panel in the LCD device of FIG. 3.

FIG. 4 shows a circuit diagram of a liquid crystal panel in the LCD device of FIG. 3.

Figure 5:
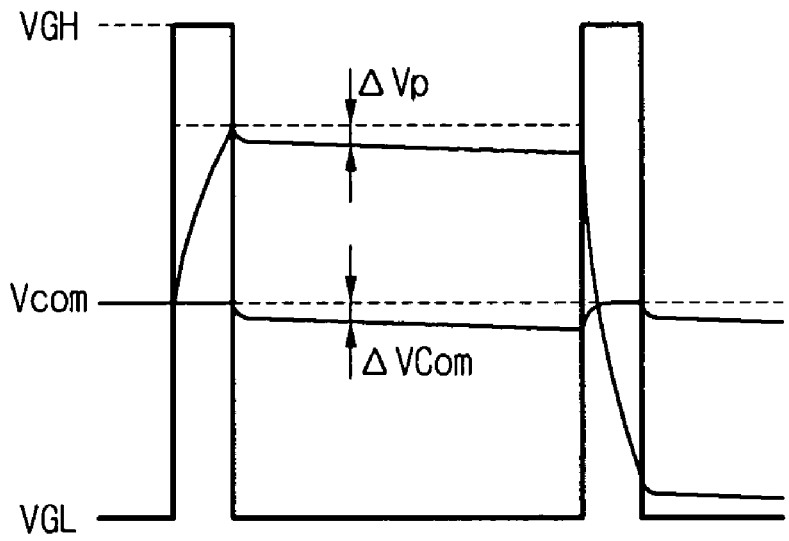
FIG. 5 shows a voltage waveform applied to the liquid crystal panel of FIG. 4.

FIG. 5 shows a voltage waveform applied to the liquid crystal panel of FIG. 4. Referring to FIG. 4, the liquid crystal panel 102 includes a plurality of gate lines GL1 to GL3 in a first direction, and a plurality of data lines DL1 to DL3 in a second direction crossing the plurality of gate lines GL1 to GL3.

A plurality of common lines VL1 to VL3 are parallel with the gate lines GL1 to GL3, respectively. Each of the common lines VL1 to VL3 is adjacent to a corresponding one of the of the gate lines GL1 to GL3.

A pixel region P is defined by each crossing of the gate lines GL1 to GL3 and the data lines DL1 to DL3. Each pixel region P includes first and second thin film transistors (TFTs) TFT-1 and TFT-2, a pixel electrode, and a common electrode. The pixel electrode is electrically connected to the first TFT TFT-1, and the common electrode is electrically connected to the second TFT TFT-2.

Each of the pixel electrode and the common electrode may include a plurality of bar-like portions. For example, bar-like portions in the pixel electrode and the common electrode may alternate with each other alternately. In an embodiment, a first bar-like portion of the pixel electrode is adjacent to a first bar-like portion of the common electrode; a second bar-like portion of the pixel electrode is adjacent to the first bar-like portion of the common electrode; and a second bar-like portion of the common electrode is adjacent to the second bar-like portion of the pixel electrode.

A gate of the first TFT TFT-1 may be connected to the gate line, a source thereof may be connected to the data line, and a drain thereof may be connected to the pixel electrode. Accordingly, a data voltage can be applied from the data line to the pixel electrode of the pixel region P by switching the first TFT TFT-1.

A gate of the second TFT TFT-2 may be connected to the gate line, a source thereof may be connected to the common line, and a drain thereof may be connected to the common electrode. Accordingly, a common voltage can be applied from the common line to the common electrode of the pixel region P by switching the second TFT TFT-2.

Thus, because the first and second TFTs TFT-1 and TFT-2 are connected to a common gate line, the first and second TFTs TFT-1 and TFT-2 are turned on simultaneously when a gate high voltage $V_{GH}$ is supplied to the common gate line. Hence, the data voltage is applied to the pixel electrode of the pixel region P through the first TFT TFT-1, and the common voltage is applied to the common electrode of the pixel region P through the second TFT TFT-2.

When the gate low voltage $V_{GL}$ is supplied to the corresponding gate line, the first and second TFTs TFT-1 and TFT-2 are turned off simultaneously. Accordingly, the data voltage is not applied to the pixel electrode and the common voltage is not applied to the common electrode.

Similarly, because the first and second TFTs TFT-1 and TFT-2 are turned on or turned off simultaneously by a scan signal supplied to a corresponding gate line, kick-back voltages may occur in the first and second TFTs TFT-1 and TFT-2.

In an embodiment, the first TFT TFT-1 has a parasitic capacitance substantially equal to that of the second TFT TFT-2. For example, the parasitic capacitance $C_{gs}$ between the gate and the source, the parasitic capacitance $C_{gd}$ between the gate and the drain, and the parasitic capacitance $C_{ds}$ between the source and the drain of the first TFT TFT-1 are substantially equal to the parasitic capacitance $C_{gs}$ between the gate and the source, the parasitic capacitance $C_{gd}$ between the gate and the drain, and the parasitic capacitance $C_{ds}$ between the source and the drain of the second TFT TFT-2, respectively.

When the parasitic capacitances of the first and second TFTs TFT-1 and TFT-2 are substantially equal, respectively, and in accordance with Equation (1), the kick-back voltages are identical in the first and second TFTs TFT-1 and TFT-2. Accordingly, flickers do not occur because the kick back voltage generated in the first TFT TFT-1 is substantially equal to the kick back voltage generated in the second TFT TFT-2.

Moreover, because there is no flicker, no further adjustment of the common voltage or the gamma value is required. Accordingly, a circuit implementation of the gamma voltage generator 110 decreases in complexity and because a gamma value adjusting unit is not required in the gamma voltage generator 110.

The pixel electrode and the common line are overlapped to form a storage capacitance $C_{st}$. The storage capacitance $C_{st}$ maintains a data voltage supplied to the pixel electrode during one frame period. Additionally, a liquid crystal capacitance $C_{lc}$ is formed by the liquid crystal between the pixel electrode and the common electrode. The liquid crystal capacitance $C_{lc}$ maintains an electric potential difference between a data voltage of the pixel electrode and a common voltage of the common electrode.

The gate lines GL1 to GL3, the data lines DL1 to DL3, the first and second TFTs TFT-1 and TFT-2, the pixel electrodes, and the common lines VL1 to VL3 are formed on a first substrate (not shown) of the liquid crystal panel. Various color filters corresponding to each of pixel regions P are disposed in a second substrate (not shown) facing the first substrate. A liquid crystal material is interposed between the first substrate and the second substrate.

The first and second TFTs TFT-1 and TFT-2 are turned on by a scan signal supplied to the gate lines GL1 to GL3 of the liquid crystal, and then a data voltage supplied to the data lines DL1 to DL3 is applied to the pixel electrode through the first TFT TFT-1. A common voltage supplied to the common lines VL1 to VL3 is applied to the common electrode through the second TFT TFT-2.

Accordingly, an electric field is generated in the pixel region P by an electric potential difference between the data voltage applied to the pixel electrode and the common voltage applied to the common electrode. A desired image is displayed by changing the optical characteristics of the liquid crystal material in accordance with the electric field.

The timing controller 108 generates a gate control signal for controlling the gate driver 104 and a data control signal for controlling the data driver 106 by using vertical/horizontal synchronization signals Vsync/Hsync supplied from an external system (not shown), a data enabler DE signal, and a predetermined clock signal. The timing controller 108 aligns data signals supplied from the external system in a format suitable for the liquid crystal panel to supply the data signals to the data driver 106.

The gate driver 104 sequentially supplies scan signals to gate lines GL1 to GLn according to the gate control signal supplied from the timing controller 108. The data driver 106 sequentially supplies scan signals to data lines DL1 to DLn according to the data control signal supplied from the timing controller 108.

The gamma voltage generator 110 generates a plurality of gamma voltages by using a power supply voltage $V_{dd}$ generated from a power supply unit (not shown). The generated gamma voltage is supplied to the data driver 106. The data driver 106 generates a data voltage by referring to the gamma voltage supplied from the gamma voltage generator 110 according to the data signal supplied from the timing controller 108. Accordingly, the gamma voltage corresponding to the data signal can be generated as the data voltage.

Figure 6:
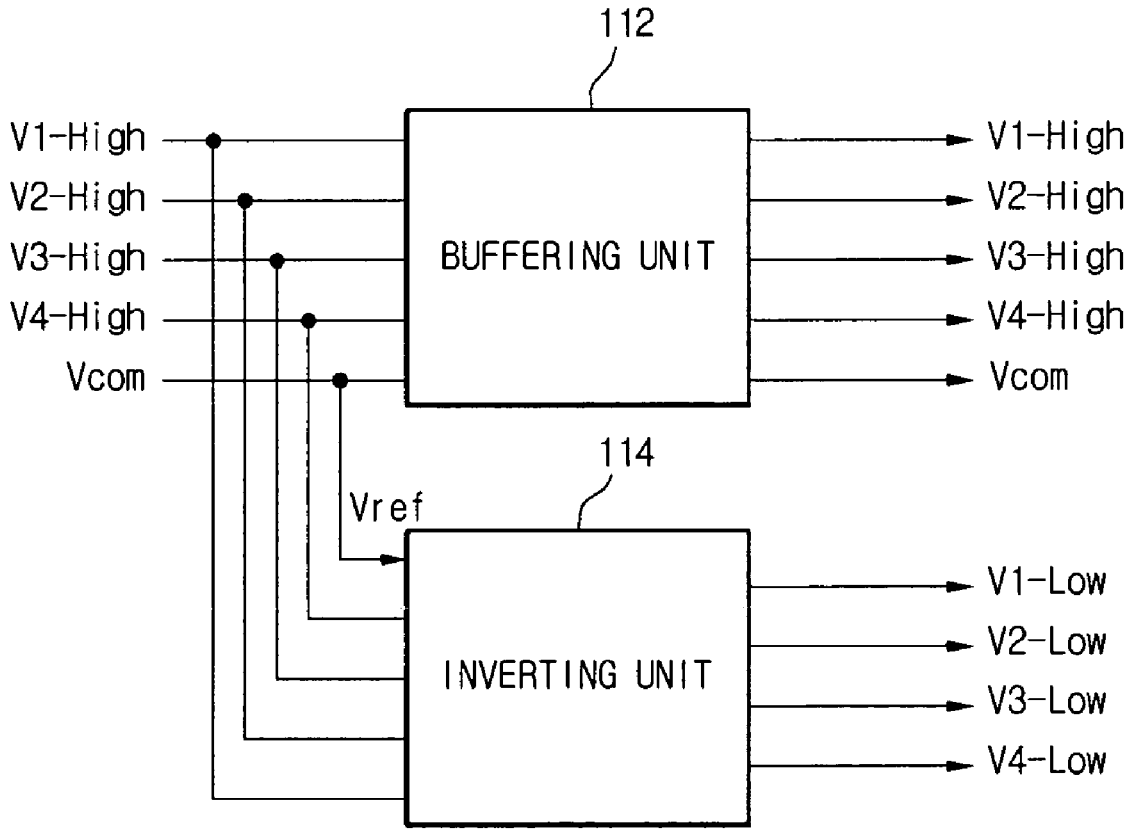
FIG. 6 shows a schematic diagram of the gamma voltage generator of FIG. 3.

FIG. 6 shows a schematic diagram of the gamma voltage generator of FIG. 3. Referring to FIGS. 3 and 6, the gamma voltage generator 110 includes a buffering unit 112 for holding a plurality of gamma voltages and an inverting unit 115 for inverting the plurality of gamma voltages. The buffering unit 112 amplifies the plurality of gamma voltages. A unit for generating a plurality of gamma voltages may be further included in the gamma voltage generator 110. For example, the plurality of gamma voltages may be generated using a voltage divider rule. The gamma voltages can be generated in a positive polarity gamma generating unit or a negative gamma generating unit (not shown).

Four exemplary gamma voltages V1-High to V4-High are shown in FIG. 6. However, in an embodiment of the present invention, more than four gamma voltages may be used. The four gamma voltages in FIG. 6 have a higher level than the common voltage and correspond to white. The gamma voltage generator 110 can generate a gamma voltage corresponding to black by using the gamma voltage corresponding to white. For example, the black grayscale can be generated by inverting the white grayscale through the inverting unit 11. Accordingly, a circuit of the gamma voltage generator 110 becomes simpler with a smaller size.

In accordance with an embodiment of the present invention, a plurality of gamma voltages V1-High to V4-High corresponding to white are supplied to the buffering unit 112. The plurality of gamma voltages V1-High to V4-High are inputted to the buffering unit 112 and the inverting unit 114 simultaneously. Moreover, a common voltage $V_{com}$ is simultaneously inputted to the buffering unit 112 and the inverting unit 114 as a reference voltage $V_{ref}$ to generate gamma voltages V1-Low to V4-Low.

The inverting unit 114 may include a plurality of inverting amplifiers to invert each of the four gamma voltages V1-High to V4-High. The common voltage $V_{com}$ and the gamma voltage corresponding to white are inputted to each of the inverting amplifiers. Each of the inverting amplifiers generates a gamma voltage corresponding to black, which is symmetrical to a gamma voltage corresponding to white, by using the common voltage $V_{com}$ as the reference voltage $V_{ref}$.

For example, when a large number of gamma voltages V2-High corresponding to white are 8 V, and a reference voltage is 5V, the inverting amplifier can generate a 2V gamma voltage V3-Low corresponding to black, which is symmetrical to the 8 V gamma voltage V2-High with respect to a reference voltage of 5V.

Accordingly, the gamma voltage generator 110 can generates the gamma voltage corresponding to white and the gamma voltage corresponding to black by only using the gamma voltage corresponding to white. Alternatively, the gamma voltage generator 110 can generates the gamma voltages corresponding to white and black by only using the gamma voltage corresponding to black.

In an embodiment of the present invention, the first TFT is connected to the pixel electrode, and the second TFT is connected to the common electrode. The first and second TFTs may be switched simultaneously. Accordingly, after causing kick-back voltages in the first and second TFTs, the kick-back voltage dropped from the data voltage is offset by the kick-back voltage dropped from the common voltage. Therefore, flickers do not occur. Hence, no adjustment of the common voltage or the gamma voltage is required to prevent flickers. Thus, a gamma voltage adjusting unit for preventing flickers is unnecessary in the gamma voltage generator. Therefore, the complexity and the size of the circuit embodying the gamma voltage generator are reduced.

Moreover, in an embodiment of the present invention, the gamma voltage generator may include a single unit for generating a gamma voltage corresponding to white. The gamma voltage corresponding to black can be generated from the single unit by inverting the gamma voltage corresponding to white. Therefore, the complexity and the size of the circuit embodying the gamma voltage generator are reduced.

Furthermore, in an embodiment of the present invention, the gamma voltage generator may include a single unit for generating a gamma voltage corresponding to black. The gamma voltage corresponding to white can be generated from the single unit by inverting the gamma voltage corresponding to black. Therefore, the complexity and the size of the circuit embodying the gamma voltage generator are reduced.

It will be apparent to those skilled in the art that various modifications and variations can be made in the exemplary embodiments of the present invention. Thus, it is intended that embodiments of the present invention cover the modifications and variations of the embodiments described herein provided they come within the scope of the appended claims and their equivalents.

What is claimed is:

1. A liquid crystal panel, comprising:

a gate line;

a data line crossing the gate line to define a pixel region;

a common line parallel to the gate line;

a first switching part in the pixel region for applying a first voltage from the data line to the pixel region; and a second switching part in the pixel region for applying a second voltage from the common line to the pixel region, wherein the first and second switching parts are simultaneously switched on through the gate line, wherein a gate electrode of the first switching part is connected to the gate line, a source electrode is connected to the data line and a drain electrode is connected to a pixel electrode, wherein a gate electrode of the second switching part is connected to the gate line, a source electrode is connected to the common line and a drain electrode is connected to a common electrode, and wherein the first and second switching parts are formed to have substantially equal kick-back voltages by having substantially equal parasitic capacitances.

2. An LCD device, including the liquid crystal panel of claim 1.

3. An LCD device, comprising:

a liquid crystal panel including a plurality of pixel regions;

a gate driver supplying scan signals to activate the pixel regions;

a gamma voltage generator, including a buffer for buffering at least a first gamma voltage and an inverter for inverting the at least first gamma voltage to generate at least a second gamma voltage symmetrical to the at least first gamma voltage with respect to a common voltage; and a data driver supplying data voltages to the activated pixel regions in accordance with the at least first and the at least second gamma voltages from the gamma voltage generators, wherein the liquid crystal panel includes a gate line, a data line crossing the gate line to define a pixel region, a common line parallel to the gate line, a first switching part in the pixel region for applying a first voltage from the data line to the pixel region and a second switching part in the pixel region for applying a second voltage from the common line to the pixel region, wherein the first and second switching parts are switched on through the gate line, wherein a gate electrode of the first switching part is connected to the gate line, a source electrode is connected to the data line and a drain electrode is connected to a pixel electrode, wherein a gate electrode of the second switching part is connected to the gate line, a source electrode is connected to the common line and a drain electrode is connected to a common electrode, and wherein the first and second switching parts are formed to have substantially equal kick-back voltages by having substantially equal parasitic capacitances.

4. The LCD device according to claim 3, wherein the first gamma voltage corresponds to white.

5. The LCD device according to claim 4, wherein the second gamma voltage corresponds to black.

6. The LCD device according to claim 3, further comprising an amplifier for amplifying at least the first gamma voltage.

7. A method for driving a liquid crystal display device including a liquid crystal panel with a plurality of pixel regions, the method comprising:

activating the pixel regions by supplying scan signals thereto;

buffering at least a first gamma voltage;

generating at least a second gamma voltage symmetrical to the at least first gamma voltage with respect to a common voltage; and supplying data voltages to the activated pixel regions in accordance with the at least first and the at least second gamma voltages, wherein the liquid crystal panel includes a gate line, a data line crossing the gate line to define a pixel region, a common line parallel to the gate line, a first switching part in the pixel region for applying a first voltage from the data line to the pixel region and a second switching part in the pixel region for applying a second voltage from the common line to the pixel region, wherein the first and second switching parts are switched on through the gate line, wherein a gate electrode of the first switching part is connected to the gate line, a source electrode is connected to the data line and a drain electrode is connected to a pixel electrode, wherein a gate electrode of the second switching part is connected to the gate line, a source electrode is connected to the common line and a drain electrode is connected to a common electrode, and wherein the first and second switching parts are formed to have substantially equal kick-back voltages by having substantially equal parasitic capacitances.

8. The method according to claim 7, wherein the first gamma voltage corresponds to white.

9. The method according to claim 8, wherein the second gamma voltage corresponds to black.

10. The method according to claim 9, including amplifying at least the first gamma voltage.

11. The method according to claim 7, further comprising:

switching a first voltage from the data line to the pixel region; and switching a second voltage from the common line to the pixel region to equalize a first kick-back voltage and a second kick-back voltage resulting from the simultaneously switching the first and second voltages to the pixel region.

* * * * *